US005445371A

United States Patent [19]

Marzullo et al.

[11] Patent Number: 5,445,371

[45] Date of Patent: Aug. 29, 1995

[54] APPARATUS AND METHOD FOR BUCKLING A SHEET

[75] Inventors: Joseph H. Marzullo, Brookfield; Brian S. Thompson, Milford, both of Conn.

[73] Assignee: Pitney Bowes Inc., Stamford, Conn.

[21] Appl. No.: 227,826

[22] Filed: Apr. 14, 1994

[51] Int. Cl.[6] ..... B65H 3/30

[52] U.S. Cl. ..... 271/21; 271/111; 271/118; 271/121

[58] Field of Search ..... 271/16, 17, 21-24, 271/110, 111, 117, 118, 121, 161

[56] References Cited

U.S. PATENT DOCUMENTS

| | | | |
|---|---|---|---|
| 2,165,232 | 7/1939 | Curtis | 271/22 |
| 3,350,089 | 10/1967 | Niccoli | 271/21 X |
| 3,888,479 | 6/1975 | Eder et al. | 271/118 X |
| 4,236,709 | 12/1980 | Hunt | 271/21 |

FOREIGN PATENT DOCUMENTS

| | | | |
|---|---|---|---|
| 23915 | 11/1967 | Japan | 271/21 |
| 102733 | 6/1984 | Japan | 271/21 |

*Primary Examiner*—H. Grant Skaggs
*Assistant Examiner*—Carol L. Druzbick
*Attorney, Agent, or Firm*—Robert H. Whisker; Melvin J. Scolnick

[57] ABSTRACT

A corner buckle feeder has a singulation roller and feed roller for initially separating and feeding glossy paper. The front corners of a sheet stack are unsupported in order to minimize the intersheet frictional forces that are influenced by temperature and humidity. The axis of the singulation roller is disposed at an angle with respect to an edge adjacent to the lead edge of the top sheet. The singulation roller drives the adjacent edge inward and the top sheet deforms along the leading edge to form a buckle.

7 Claims, 3 Drawing Sheets

APPARATUS AND METHOD FOR BUCKLING A SHEET

BACKGROUND OF THE INVENTION

The invention relates to an apparatus for feeding sheets seriatim from a stack of sheets and, in particular, to an apparatus for buckling and separating a sheet from a stack of sheets in order to feed one sheet at a time.

In most printing, duplicating, and mailing machines, there is an apparatus for feeding sheets from a stored sheet stack into the machine for further processing. The process for removing a sheet from a sheet stack is called singulation. The prior art is replete with apparatus for buckling then separating the top or bottom sheet from a sheet stack pursuant to feeding sheets seriatim through an apparatus, but suffer from one or more of the following shortcomings. In some instances, singulators are incapable of handling sheets of various thickness. In other instances, glossy coated sheets are very difficult to singulate because the sheets have a tendency to stick together. This is believed to be caused by inter-sheet frictional forces that are influenced by such ambient factors as temperature and humidity, as well as by inherent factors, such as the sheet finish, the type and grade of the sheet, and the mechanical properties of the sheet. Most feeders that deliver glossy paper singulate using air and/or a vacuum sheet feeder to separate each sheet from a stack of sheets. These systems are expensive, noisy, and thus ill-suited for use in an office environment.

SUMMARY OF THE INVENTION

The present invention is directed to a corner buckle feeder designed to buckle, singulate, and feed glossy paper without substantial influence by such ambient factors as temperature and humidity. A corner buckle feeder having features of the present invention comprises a sheet supply means and a singulation roller. The axis of the singulation roller is disposed at an angle with respect to an adjacent edge of the top sheet. In addition, the singulation roller is positioned between a leading edge of the top sheet and an adjacent edge of the top sheet. Preferably, the distance between the intersection of the singulation roller axis with the leading edge and the adjacent edge is less than one-half the width of each sheet. The singulation roller is in rolling contact with the top sheet so as to create a buckle in the leading edge. Sensing means are provided to sense the presence of the buckled leading edge portion of each sheet. A separator proximate to the leading edge of the top sheet separates the top sheet from a stack of sheets as the top sheet is fed forward. A feed roller is positioned in rolling contact with the top sheet for feeding the top sheet in singular sequence when the sensing means senses the buckle.

The corner buckle feeder further comprises a rocker assembly positioned above the stack of sheets. The rocker assembly has a pivotable base and a rack gear fixably mounted to the internal frame. A pinion gear is connected to the rack gear so that in a neutral position, the stack of sheets remain free of contact by the singulation roller or feed roller. A motor or other driving means can rotate the pinion gear in a forward direction so that the pinion gear travels along the rack gear thereby pivoting the base forward. As the pinion gear approaches a forwardmost point on the rack gear, the singulation roller will contact a sheet. Likewise, a motor or other driving means can rotate the pinion gear in a rearward direction so that the pinion gear travels along the rack gear thereby pivoting the base. As the pinion gear approaches a rearwardmost point on the rack gear, the feed roller contacts a sheet.

BRIEF DESCRIPTION OF THE DRAWINGS

These and other features, aspects, and advantages of the present invention will become better understood with regard to the following description, appended claims, and accompanying drawings where:

FIGS. *2a*, *2b*, and *2c* show a series of schematic illustrations showing an enlarged, partial elevation of the rocker assembly in three positions.

DESCRIPTION OF THE PREFERRED EMBODIMENTS

Figure 1:
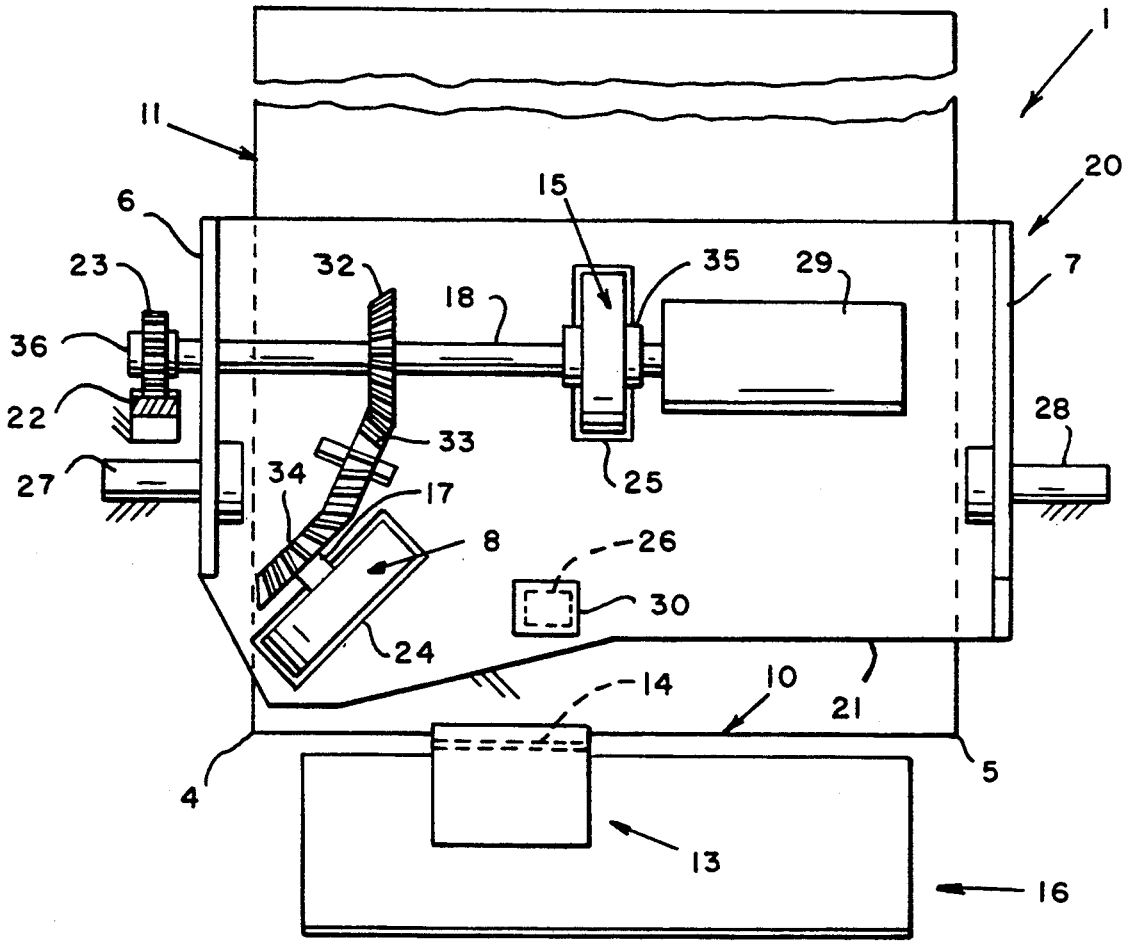
FIG. 1 shows a top view of the invention.

FIG. 1 illustrates a preferred embodiment of the invention. In this embodiment, the corner buckle feeder 1 comprises a base 2 attached to an internal frame for holding a stack of sheets 3. The front corners 4, 5 of these sheets are unsupported and tend to lean downward, fanning out, and separating at the front corners 4, 5. Side walls 6, 7 are disposed one along each opposite side of base 2 for laterally retaining the stack 3. Exit ramp 16 is fixedly mounted to the internal frame for receiving sheets fed seriatim from stack 3. Separator 13 is fixedly mounted to the exit ramp 16. The separator 13 is spring loaded down and disposed slightly forward of the leading edge 10 of stack 3.

A singulation roller 8 is suitably mounted on shaft 17 for engaging the top sheet 19 of the stack 3. The singulation roller 8 is positioned between the leading edge 10 of each sheet and an adjacent edge 11 of each sheet. For optimum results, the distance between the intersection of the singulation roller axis with the leading edge 10 and an adjacent edge 11 should be less than one-half the width of each sheet. The axis of the singulation roller 8 is disposed at an angle $\theta$ with respect to the adjacent edge 11 of each sheet. For best results, the angle $\theta$ should be in the range of about 35° to 55°, with 45° being preferred. The spacing distance and angle $\theta$ are selected to minimize the inter-sheet frictional forces that are influenced by such ambient factors as temperature and humidity by decreasing the surface area upon which the singulation roller 8 must act.

A rocker assembly, generally designated by the numeral 20 in FIG. 1, is mounted above the stack of sheets 3 between side walls 6, 7. The rocker assembly 20 comprises a pivotable base 21 which rotates about pivot pins 27, 28. Sensor assembly 30 is mounted on pivotable base 21 and positioned to sense a buckle 12 in the top sheet 19. The pivotable base 21 has slots 24, 25, 26 for the singulation roller 8, feed roller 15, and sensor assembly 30, respectively. Rack gear 22 is fixably mounted to the internal frame and pinion gear 23 is operatively connected to the rack gear 22. The pinion gear is driven by motor 29 through friction clutch 36.

The feed roller 15 and singulation roller 8 are driven by motor 29 through overrunning clutch 35. The motor 29, pinion gear 23, and feed roller 15 have a common shaft 18 on which is mounted a gear 32 which is in drive communication with idler gear 33. The idler gear 33 is adapted to drive gear 34 which is affixed to shaft 17 thereby imparting rotation to the singulation roller 8.

Figure 2A:
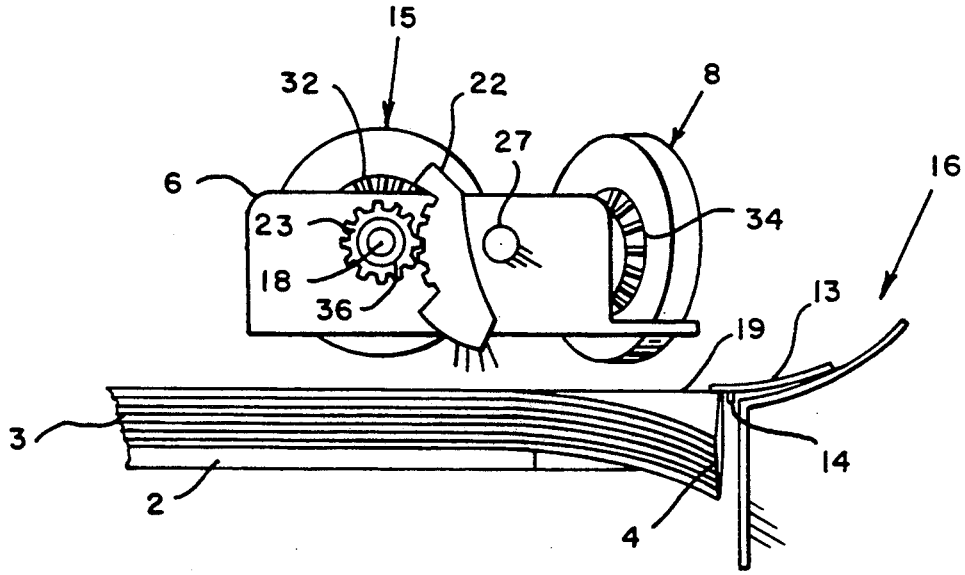
Figure 2B:
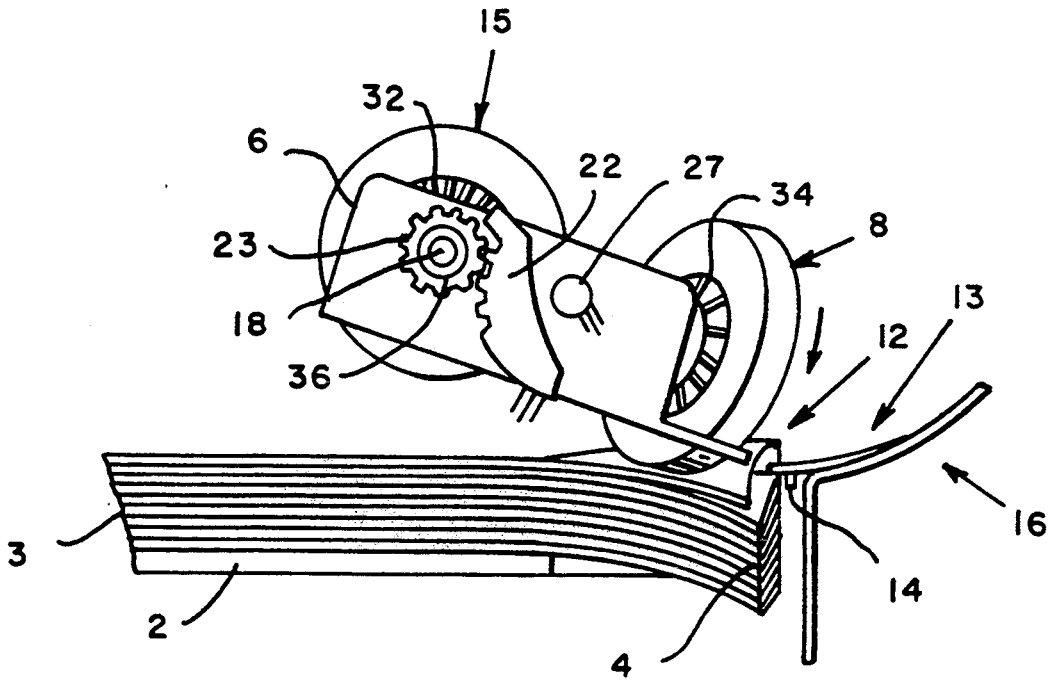
Figure 2C:
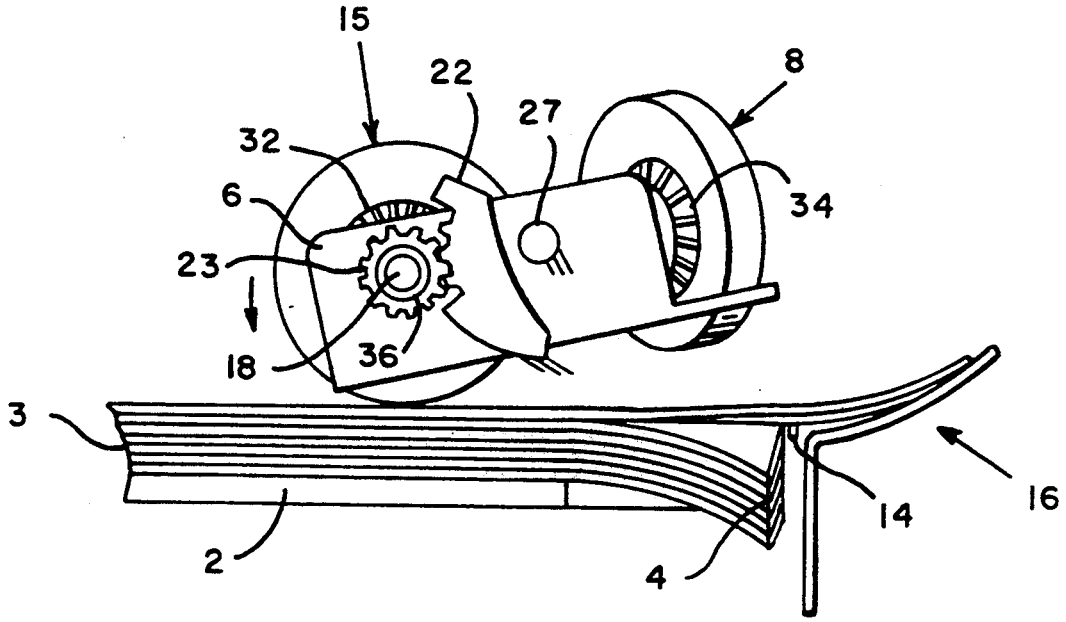

Turning now to FIGS. 2*a–c*, the operation of a specific embodiment of the present invention is illustrated. The separator 13 is spring loaded down and disposed slightly forward of the leading edge 10 of stack 3. The front corners 4, 5 of these sheets are unsupported and tend to lean downward, fanning out, and separating at the front corners 4, 5 which improves singulation of the top sheet 19 as it buckles. Initially, the pivotable base 21 is in the neutral position (see FIG. 2*a*). In that position, there is no significant normal force applied to the sheet stack 3. The pinion gear 23 rests in a substantially central position along the rack gear 22. While the pinion gear 23 and rack gear 22 remain in that position, the pivotable base 21 maintains a neutral position so that neither the singulation roller 8 nor the feed roller 15 rest on the sheet stack 3. In order to singulate, the motor 29 rotates in a clockwise direction. This will in turn rotate the pinion gear 23 forward along the rack gear 22. As the pinion gear 23 approaches a forwardmost point on the rack gear 22, the pivotable base 21 begins to tilt forward around pivot pins 27, 28. The motor 29 through gears 32, 33, and 34, also rotates the singulation roller 8 in a clockwise direction. Once the pivotable base 21 reaches the singulation position, the singulation roller 8 comes into rolling contact with the top sheet 19, driving adjacent edge 11 inward to create buckle 12 (see FIG. 2*b*). The small tractive engagement of the singulation roller 8 with the top sheet 19 produces a downward shearing singulation force across a limited surface area of less than one-half the width of a sheet. To form buckle 12, the singulation force overcomes the normal frictional resistance between the top sheet 19 and an adjacent sheet. Under the influence of the singulator 8, the adjacent edge 11 is driven inward and the top sheet 19 deforms along leading edge 10. The deformation increases, the top sheet 19 is buckled away from and upwardly over the separator 13, and thus ultimately separated from the stack 3.

When the sensor assembly 30 detects the presence of buckle 12, the corner buckle feeder 1 prepares to feed the top sheet 19 through the exit ramp 16. The motor 29 reverses direction. This will in turn rotate the pinion gear 23 rearward along the rack gear 22. As the pinion gear 23 approaches the neutral position, the pivotable base 21 pivots up around pivot pins 27, 28 and the singulation roller 8 no longer contacts the top sheet 19. At that point, the top sheet 19, separated from the stack 3, rests on top of the separator 13. As the pinion gear 23 approaches a rearwardmost point on the rack gear 22, the pivotable base 21 begins to tilt rearward around pivot pins 27, 28. Once the pivotable base 21 reaches the feed position where the feed roller 15 comes into contact with the sheet stack 3, feeding of the top sheet 19 occurs (see FIG. 2*c*). The separator 13 has an edge 14 which prohibits the adjacent sheet from moving forward when feeding the top sheet 19 through the corner buckle feeder 1 and onto the exit ramp 16.

Figure 3:
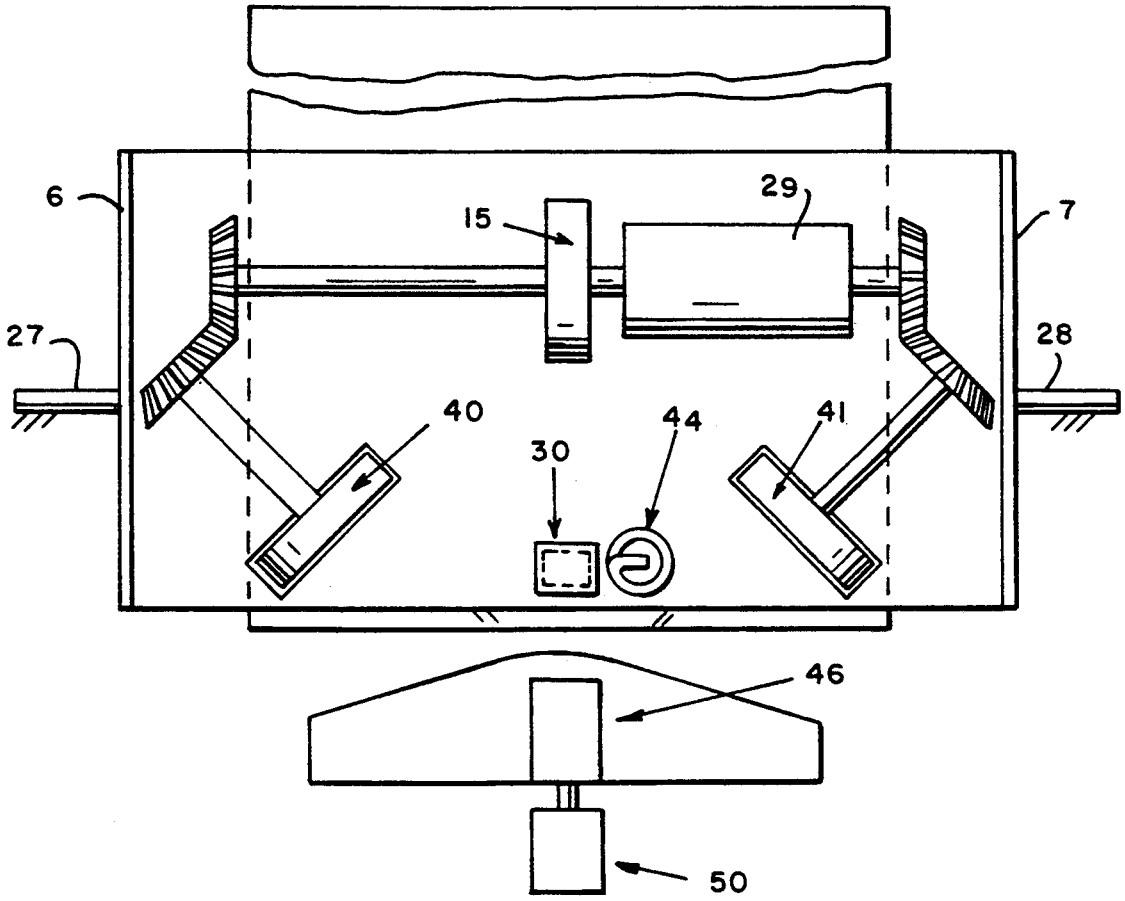
FIG. 3 shows a top view of a corner buckle feeder with two singulation rollers.

In the embodiment represented in FIG. 3, the corner buckle feeder 1 uses two singulation rollers 40 and 41 to drive both edges adjacent to the leading edge 10 of the top sheet 19 inwards to create a buckle 12 in the leading edge 10 of the top sheet 19. Spring 44 forces the pivotable base 21 down until the singulation rollers 40 and 41 contact the top sheet 19. When the sensor assembly 30 detects the presence of buckle 12, sensor 30 energizes solenoid 50, injecting a plow-shaped interposer 46 into the separation formed between the top sheet 19 and an adjacent sheet. As the plow-shaped interposer 46 reaches a full forward position, the base 21 pivots towards the feed position where the feed roller 15 comes into contact with the top sheet 19. When the interposer 46 reaches a full forward position, the motor 29 drives feed roller 15 which in turn drives the top sheet 19 forward, over the interposer 46, and out of the feeder 1.

This and other variations and modifications, as will be evident to those skilled in this art, may be made therein without departing from the spirit of the invention, and the invention as set forth in the appended claims is thus not to be limited to the precise details of construction set forth above as such variation and modifications are intended to be included within the scope of the appended claims.

What is claimed is:

1. A comer buckle feeder, which comprises:

sheet supply means for storing a plurality of sheets;

singulation roller means positioned in rolling contact with a top sheet for driving an edge adjacent to a leading edge of the top sheet inwards to create a buckle in the leading edge of the top sheet, whereby the axis of the singulation roller means and the adjacent edge of the top sheet form an acute angle;

sensing means operatively positioned with respect to the top sheet for sensing the buckled edge portion of the top sheet;

feed roller means responsive to the sensing means for feeding the top sheet in singular sequence from the sheet supply means when the sensing means senses the buckle; and a separator proximate to the leading edge for separating the buckled edge of the top sheet from the plurality of sheets as the top sheet is fed forward.

2. The comer buckle feeder of claim 1 wherein the axis of the singulation roller means and the adjacent edge of the top sheet form an angle of between 35° and 55°.

3. The comer buckle feeder of claim 1, wherein the front comers on at least one side of the plurality of sheets are unsupported by a base and are thereby free to lean fanningly downward.

4. The comer buckle feeder of claim 1, further comprising a rocker assembly positioned above the sheet supply means, which comprises:

a rack gear;

a pinion gear operatively connected to the rack gear so that in a neutral position, the top sheet remains free of contact by the singulation roller means or feed roller memos;

a pivotable base;

a forwardly driving means for forwardly rotating the pinion gear, the pinion gear travels along the rack gear thereby pivoting the base so that the singulation roller means contacts the top sheet; and a rearwardly driving means for rearwardly rotating the pinion gear, the pinion gear travels along the rack gear thereby pivoting the base so that the feed roller means contacts the top sheet.

5. The comer buckle feeder of claim 4 wherein the singulation roller means is positioned between the leading edge of the top sheet and the adjacent edge of the top sheet, the distance between the intersection of the singulation roller means axis with the leading edge and the adjacent edge is less than one-half the width of each sheet.

6. A comer buckle feeder, which comprises:

sheet supply means for storing a plurality of sheets;

singulation roller means for driving a plurality of edges adjacent to a leading edge of a top sheet inwards to create a buckle in the leading edge of the top sheet, whereby the axis of the singulation roller means and the plurality of edges adjacent to the leading edge of the top sheet form an acute angle;

sensing means operatively positioned with respect to the top sheet for sensing the buckled edge portion of the top sheet;

feed roller means responsive to the sensing means for feeding the top sheet in singular sequence from the sheet supply means when the sensing means senses the buckle; and a separator proximate to the leading edge for separating the buckled edge of the top sheet from the plurality of sheets as the top sheet is fed forward.

7. A method of separating a top sheet from a sheet stack, which comprises: positioning a singulation roller at an acute angle with respect to a leading edge of the top sheet, driving an edge adjacent to the leading edge of the top sheet inwards to create a buckle in the top sheet; sensing the buckled edge portion of the top sheet; separating the top sheet from the sheet stack; and feeding the top sheet in singular sequence from the sheet stack.

* * * * *